US011993947B2

(12) United States Patent
Larsen

(10) Patent No.: US 11,993,947 B2
(45) Date of Patent: May 28, 2024

(54) APPARATUS AND RELATED METHODS FOR MODIFYING FENCE

(71) Applicant: Charles Larsen, Huntington Beach, CA (US)

(72) Inventor: Charles Larsen, Huntington Beach, CA (US)

( * ) Notice: Subject to any disclaimer, the term of this patent is extended or adjusted under 35 U.S.C. 154(b) by 16 days.

(21) Appl. No.: 17/035,637

(22) Filed: Sep. 28, 2020

(65) Prior Publication Data

US 2021/0010290 A1 Jan. 14, 2021

Related U.S. Application Data

(63) Continuation of application No. 14/997,208, filed on Jan. 15, 2016, now Pat. No. 10,787,838.

(60) Provisional application No. 62/104,017, filed on Jan. 15, 2015.

(51) Int. Cl.
*E04H 17/14* (2006.01)
*E04H 17/16* (2006.01)

(52) U.S. Cl.
CPC ..... *E04H 17/1426* (2013.01); *E04H 17/166* (2013.01)

(58) Field of Classification Search
CPC .. E04H 17/24; E04H 17/1413; E04F 11/1861; E04F 11/1834
See application file for complete search history.

(56) References Cited

U.S. PATENT DOCUMENTS

| | | | | |
|---|---|---|---|---|
| 10,787,838 | B2 * | 9/2020 | Larsen | E04H 17/166 |
| 2012/0187359 | A1 * | 7/2012 | Carmichael | E04H 17/08 256/59 |
| 2014/0110653 | A1 * | 4/2014 | DeSouza | E04H 17/1413 256/65.01 |
| 2014/0252290 | A1 * | 9/2014 | Lachenberg | B23K 9/092 256/22 |

* cited by examiner

*Primary Examiner* — Daniel J Wiley
(74) *Attorney, Agent, or Firm* — J. MARK HOLLAND + ASSOCIATES; J. Mark Holland; Alison Adnari

(57) ABSTRACT

Methods and apparatus are disclosed for an improved barriers and fence systems, including a supplemental panel for fences or gates or the like, alone and or in combination with such pre-existing fences/gates or similar elements. The supplemental panel can be fabricated using relatively cost-effective materials and processes, and effectively reduces the space or gaps between generally vertical pickets and/or horizontal elements on an existing fence/gate/etc., and is readily mounted and racked into generally parallel alignment with those existing generally vertical pickets, and the mounting can be independent of the racking function/structure (such as by bending the added vertical picket elements at a selected/provided location on each added picket). The added vertical elements can be low-visibility and selectively spaced laterally to fit aesthetically between the existing pickets.

17 Claims, 17 Drawing Sheets

APPARATUS AND RELATED METHODS FOR MODIFYING FENCE

RELATED APPLICATIONS

This application is a continuation of U.S. patent application Ser. No. 14/997,208, filed Jan. 15, 2016 (issued as U.S. patent Ser. No. 10/787,838 on Sep. 29, 2020) which is based on and claims priority to U.S. Provisional Application Ser. No. 62/104,017, filed Jan. 15, 2015, and incorporates the entirety of same by reference herein.

FIELD OF THE INVENTION

This invention relates broadly to fence and similar structures, including specifically those having a series of spaced parallel elements mounted on generally horizontal support elements. As used herein, "fence" is intended to include not only conventional fence panels and other assemblies but also gates and other similarly-constructed barriers.

A common form of such fences is fabricated from wrought-iron or similar materials. Persons of ordinary skill in the art will understand that, although frequently such fences are installed and used on generally flat terrain (and thus have generally horizontal support elements that generally parallel the underlying terrain), sometimes such fences traverse up and/or down slopes, and thus are "racked" so that the vertical members remain generally vertical even though the "horizontal" members may in fact depart from horizontal and may generally parallel the "slope" of the terrain across which the horizontal members are positioned. Persons of ordinary skill in the art will understand that, depending on the context, the word "horizontal" is used herein to describe horizontal members that are truly "level", those angled to generally track the slope of the terrain, or both. Likewise, as used herein, "vertical" is intended to encompass absolutely vertical elements (referred to herein sometimes as "pickets") as well as similar elements that are generally and/or approximately vertical.

Among other things, the present invention can be used to modify existing fences of this type, to effectively reduce or otherwise modify the space between the already existing vertical members and/or the already existing horizontal members. This can be useful, for example, to make it less likely that a pet can make its way through the gaps between those members. Thus, a small pet that could otherwise escape between the vertical members of an unmodified fence may not be able to escape through the smaller "gaps" resulting from modification achieved via the present invention.

As indicated herein, the inventions disclosed herein can be used in a broad range of applications and provide many benefits. For example, preferably the inventions can be provided and used in a way that is aesthetically pleasing, is easy to install and use, and provides a safe environment and resulting structure.

BACKGROUND OF THE INVENTION

Fencing and gates can be provided in many forms and for many purposes. When fencing is constructed with generally vertical "pickets" spaced from each other in a generally parallel manner, the spacing between those pickets can allow pets and/or other animals to pass through those gaps between the pickets. Depending on the circumstances, that can be dangerous to the pets and/or otherwise undesirable.

Some homeowners address such issues by adding mesh or other material near the bottom of the fence/gate, to block or reduce the gaps between the vertical fence elements. Some pets tend to climb the mesh and thereby escape and/or further endanger themselves. Products are available as "large collars" that can be placed around the pet's neck to prevent the pet from fitting between the vertical pickets. Some fence makers have modified their "complete panels" of pickets to include at the bottom additional and more tightly-spaced short pickets, to similarly block/reduce the passage between the taller pickets.

One recently published application (US20140110653) is directed to a "supplemental" panel, that relies on "a plurality of attachment components" (such as screws, rivets, etc.) to allow the added pickets to be rotated on the horizontal rail into a position parallel to the existing full-length pickets in the fence. As mentioned above, for aesthetic and other reasons, typically the "main" or existing pickets and fence panels are installed and assembled so that the pickets are generally vertical, even though the terrain in which the fence is located may be sloping or otherwise not level. This means that, to keep the bottom of the fence pickets sufficiently close to the ground or underlying surface, the pickets have to be staggered in their vertical position—pickets over a "lower" area of terrain have to be lower than those over a higher portion of terrain, even if those areas are beside each other. Thus, a "fixed" supplemental panel (such as that shown in the aforementioned US20140110653) needs to be adjustable (or "rackable" within the industry terminology) to accommodate such slopes or grade changes—the added pickets must be able to be shifted (while remaining parallel to each other) to track the grade of the underlying surface or terrain, and thereby presumably be positioned parallel with the existing vertical fence pickets.

BRIEF DESCRIPTION OF THE DRAWINGS

FIG. 5 also illustrates some of the many alternative embodiments for attaching a supplemental panel to a main/existing fence panel, such as by using various combinations and positions of clip elements such as those shown in FIGS. 6, 7, and 8. Persons of ordinary skill in the art will understand that the assembly of the supplemental panel to the main panel can be accomplished in any suitable manner.

FIG. 8A is a foreshortened front elevation view similar to FIG. 7A, illustrating an embodiment of the invention in which the supplemental panel is not "racked" but instead is generally on a "true" horizontal orientation. FIG. 8B is a side elevation view taken along line 8B-8B of FIG. 8A. FIG. 8C is similar to FIG. 8A, but shows an embodiment of the invention in which the supplemental panel is "racked" (sloping downward to the right as viewed in FIG. 8C) instead of being on a "true" horizontal orientation. FIG. 8D is similar to FIG. 8B, but illustrates yet another embodiment of the invention in which both an upper and lower clamp assembly can be positioned "extending upwardly" from the respective horizontal elements of the supplemental panel that they are clamping to the main existing fence panel (in other words, in contrast to the embodiment of FIG. 8B, the upper set screw 67 and other elements of the clamp assembly are positioned above the upper horizontal element of the supplemental panel).

DETAILED DESCRIPTION OF EMBODIMENTS

As indicated above, the inventions disclosed herein can be used in a broad range of applications and provide many benefits. One object of the invention is to provide an improved apparatus and methods for modifying a fence, gate, or similar barrier to reduce the spaces that exist between vertical pickets and/or horizontal elements of that existing structure.

Although the invention can be practiced using a wide variety of materials and fabrication methods, preferably a supplemental fence apparatus or panel is fabricated in a simple construction, using wire or extruded plastic rather than tubes of metal or other materials. Such tubes of metal or other materials can be used in some of the many alternative embodiments of the invention, but typically will be heavier and/or have other drawbacks as compared to simpler constructions/embodiments.

Figure 1:
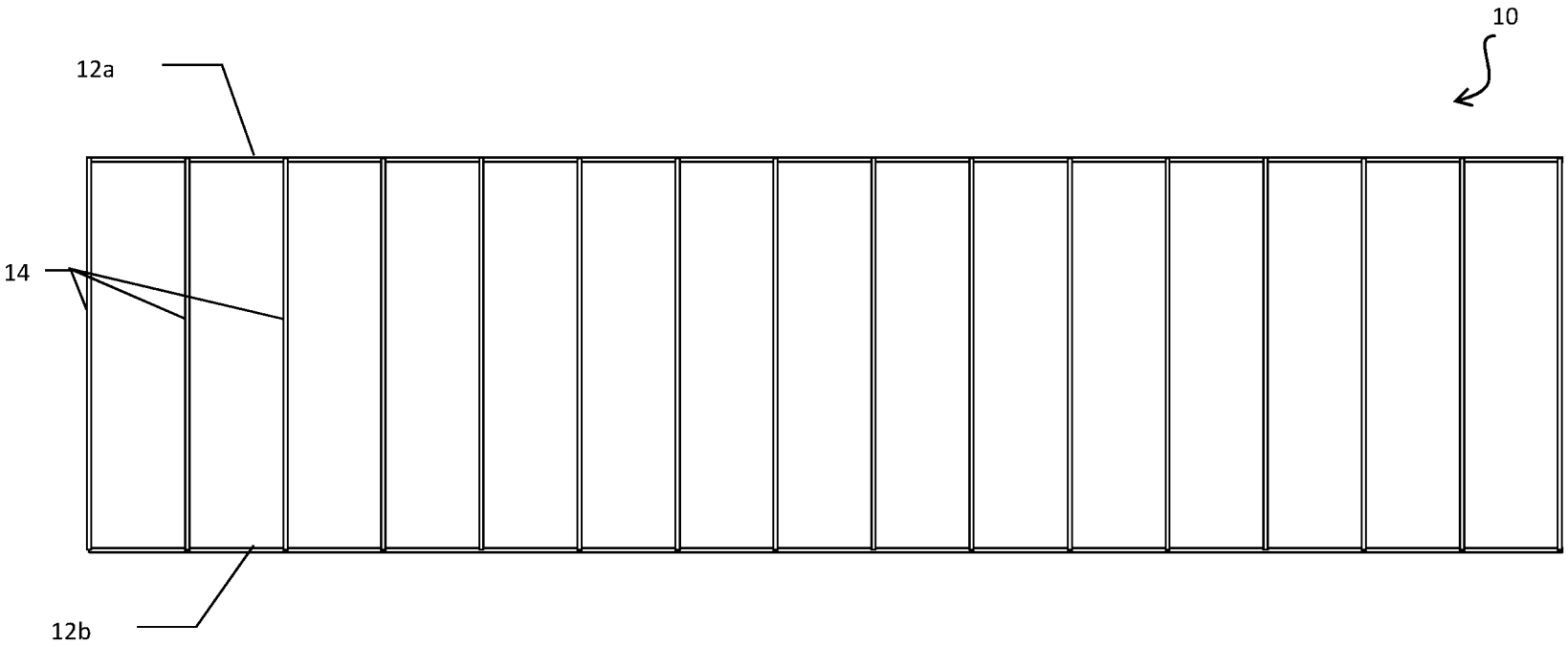
FIG. 1 is an elevation view of one of the many embodiments of a supplemental fence apparatus/panel of the invention.

Preferably, embodiments include at least one generally horizontal element 12 (but persons of ordinary skill in the art will understand that embodiments can include a plurality of such elements such as 12*b* in FIG. 1, and other such elements (not shown) generally parallel to elements 12 and/or 12*b*. Although the horizontal elements 12 and 12*b* are shown generally at or near the ends of the pickets 14, persons of ordinary skill in the art will understand that in other embodiments they can be positioned elsewhere. For the desired racking discussed herein (see, for example, FIG.

5 and related discussion), the intersection of the supplemental panel's pickets 14 and rails 12/12*b* is generally shown in FIG. 1.

Figure 2:
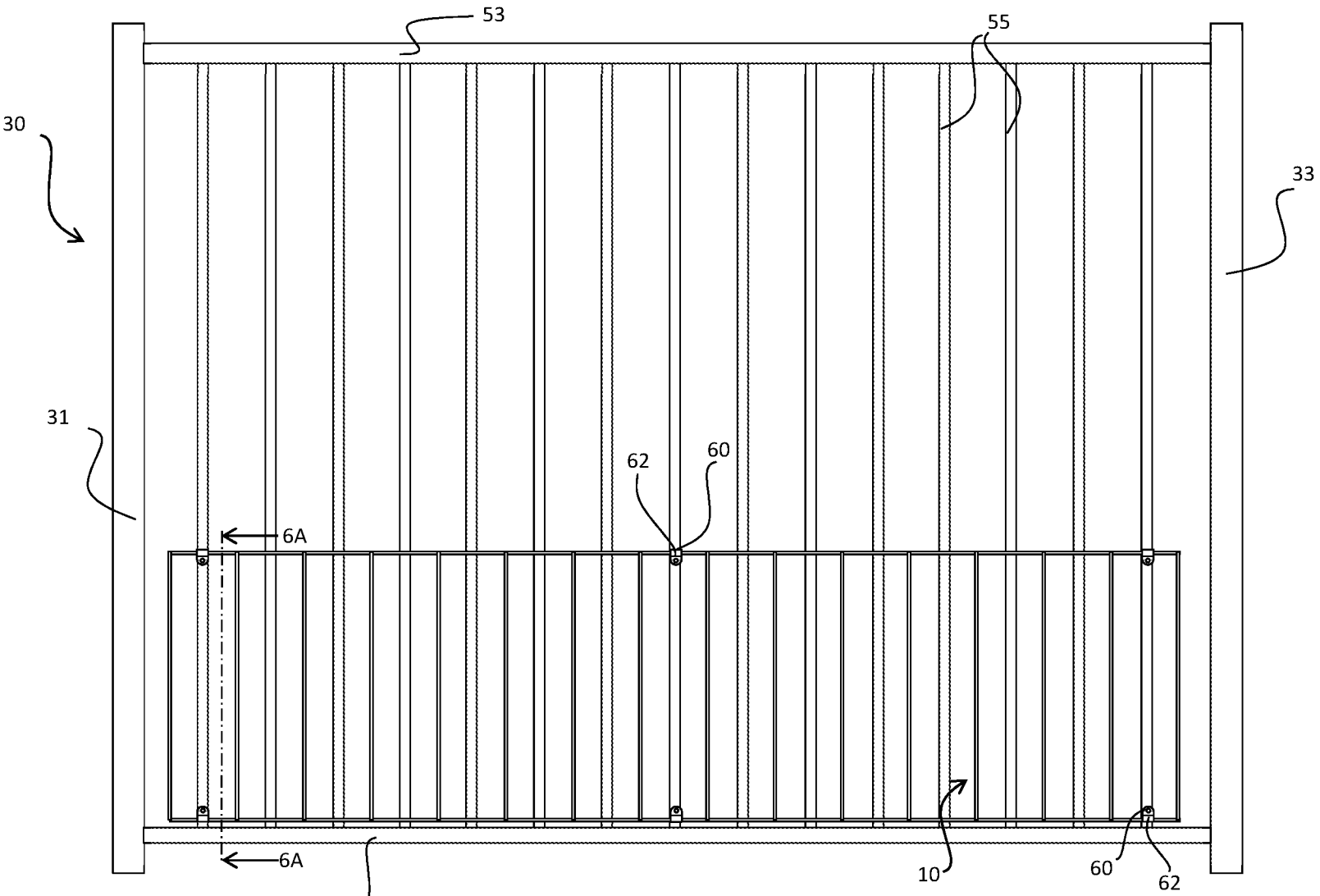
FIG. 2 is another elevation view that illustrates how the apparatus of FIG. 1 can be assembled onto an existing fence structure.
Figure 3:
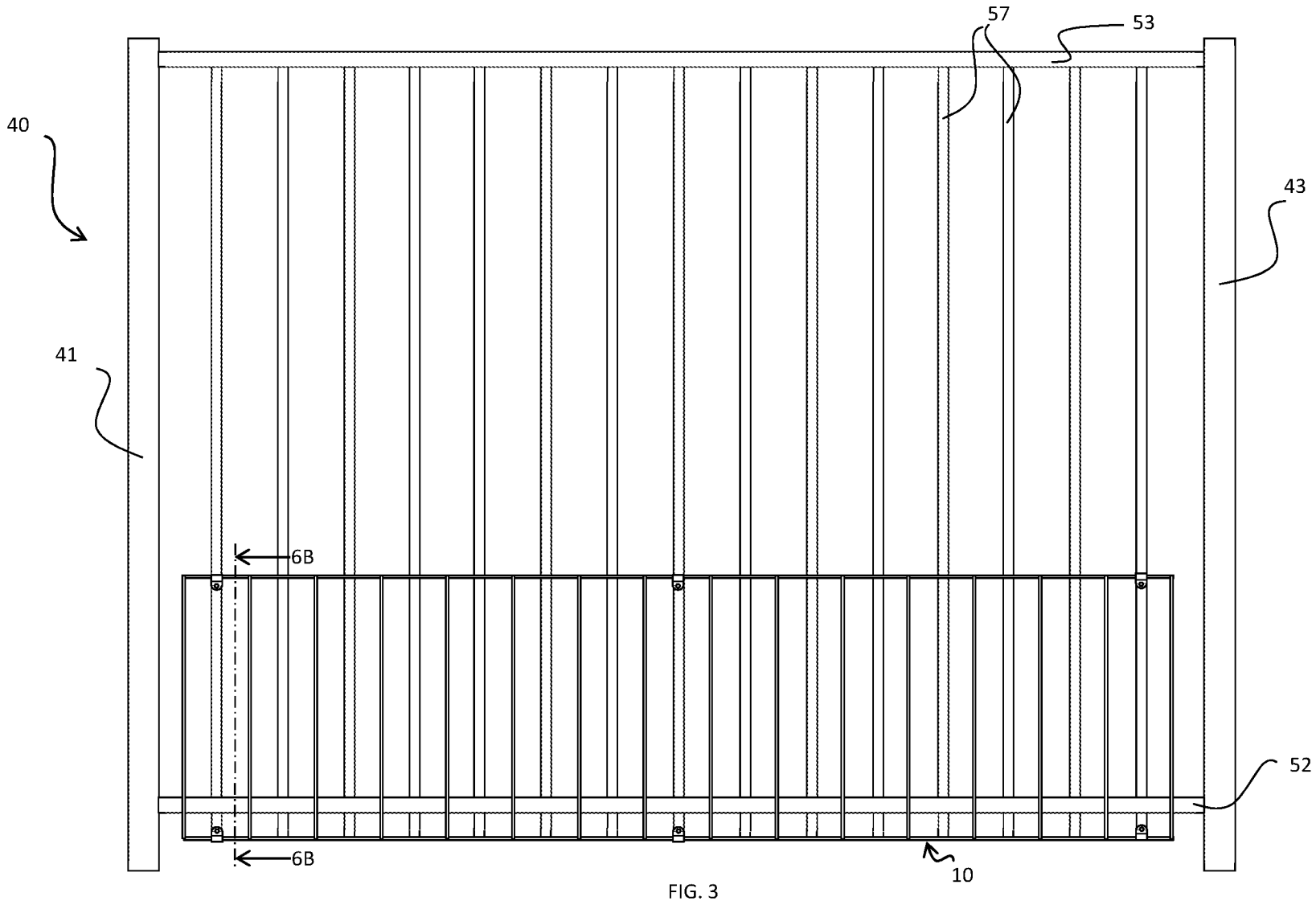
FIG. 3 is similar to FIG. 2, but shows the supplemental fence apparatus/panel positioned relatively lower with respect to the existing fence structure.

A plurality of pickets 14 preferably is provided and welded or molded or otherwise operatively affixed to the rail(s) 12 and/or 12*b* as shown in FIG. 1. The assembly 10 can be operatively attached to an existing fence structure in any suitable manner and any desired position, including those shown in the examples of FIGS. 2, 3, and 5 (shown mounted onto existing fence structures 30, 40, and 50 respectively). Persons of ordinary skill in the art will understand that these pre-existing panels are shown in merely exemplary manners, but can be configured in many other arrangements, including regarding the number and spacing and relative dimensions of the various elements in any specific embodiment of the existing fence structure. In FIG. 2, for example, structure 30 is shown as having main vertical posts 31 and 33, with horizontal elements 50 extending therebetween and vertical elements or pickets 55 connected to the horizontal elements 50. In FIG. 3, the lower horizontal element is identified as element 52, in part because it is positioned slightly higher up the main vertical elements 41 and 43 to which it is affixed (as compared to element 50 of FIG. 2). This results in a larger gap between element 52 and the underlying ground or grade, and in such embodiments, it can be useful to position the supplemental panel to extend below the main panel horizontal member 52 (as in FIG. 3), to assist in blocking or deterring pets from squeezing under the bar 52.

Figure 6C:
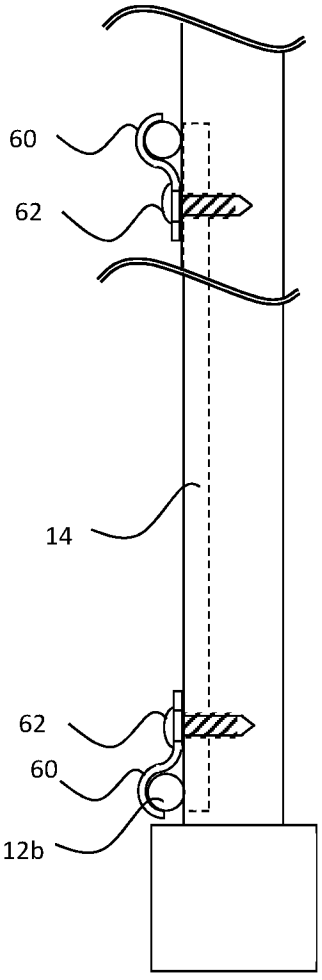
FIG. 6C is similar to FIG. 6A, but illustrates one of the many alternative embodiments of the invention in which the supplemental fence apparatus/panel of the invention is "reversed" so that the panel's vertical elements 14 are to the right of its horizontal members 12*b* when viewed in FIG. 6C (in contrast to elements 14 being to the left of the horizontal members 12*b* when viewed in FIG. 6A).
Figure 6B:
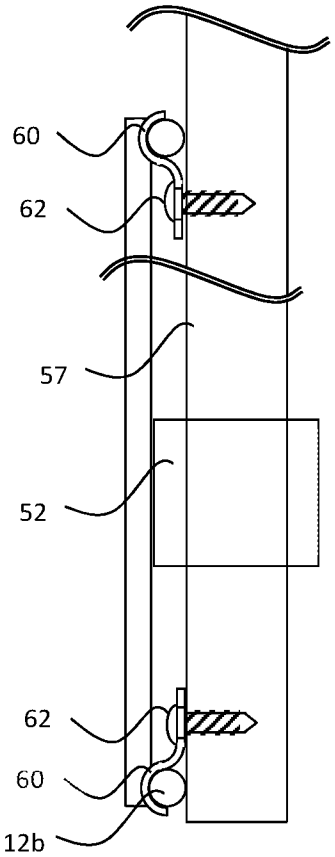
FIG. 6B is a foreshortened side elevation view taken along line 6B-6B of FIG. 3, and illustrates one of the many ways in which the supplemental fence apparatus/panel of the invention can be affixed to an existing fence structure (such as in the assembly shown in FIG. 3).
Figure 6A:
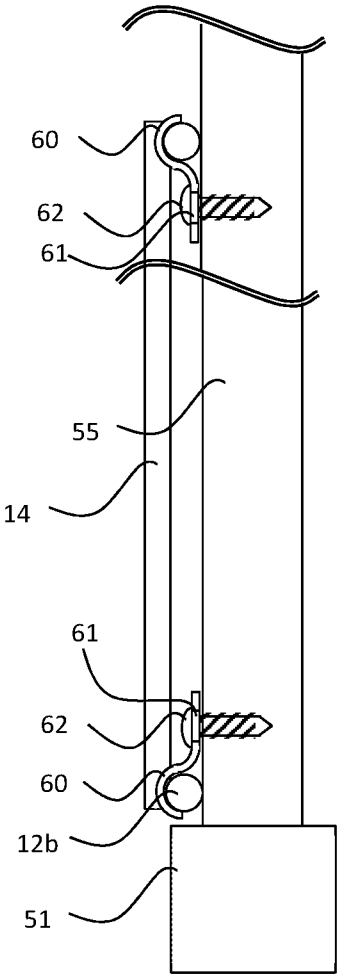
FIG. 6A is a foreshortened side elevation view taken along line 6A-6A of FIG. 2, and illustrates one of the many ways in which the supplemental fence apparatus/panel of the invention can be affixed to an existing fence structure (such as in the assembly shown in FIG. 2).
Figure 7C:
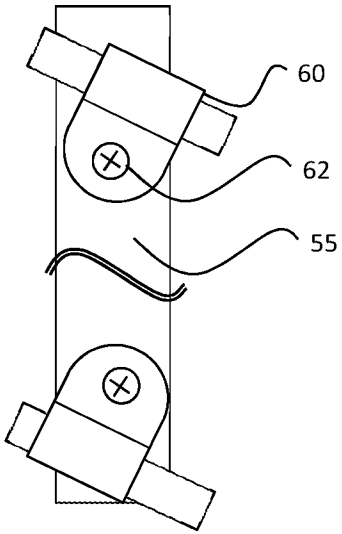
FIG. 7C is similar to FIG. 7A, but illustrates the supplemental fence apparatus in a racked or sloped relationship with the existing fence structure, such as shown in FIG. 5.
Figure 7B:
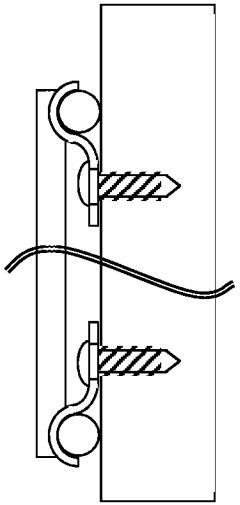
FIG. 7B is a side elevation view of the apparatus of FIG. 7A.
Figure 7A:
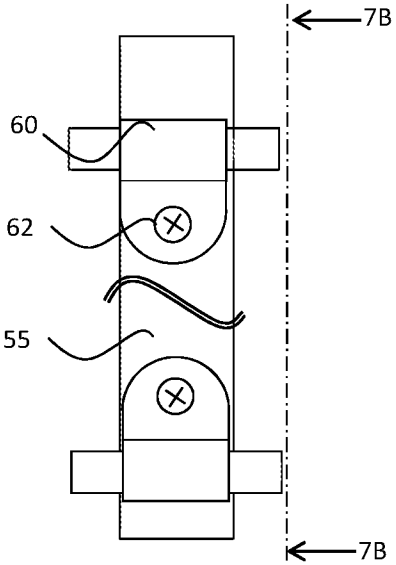
FIG. 7A is a further foreshortened front elevation view of the apparatus of FIG. 6B.
Figure 8D:
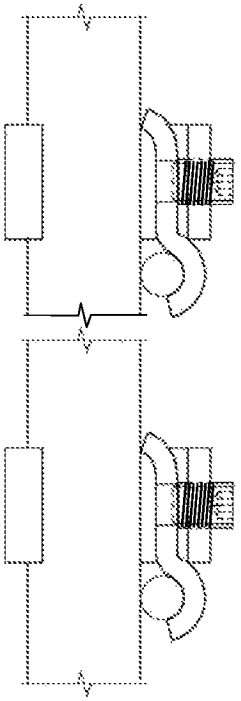
FIGS. 8A-D illustrate some of the many alternative ways to attach a supplemental panel to an existing fence section/panel, including using a clamp with a set screw to hold a clip element in a desired location on the existing panel. Among other things, this eliminates the need to screw into the existing fence picket (leaving the original fence panel "undamaged" so the supplemental panel can be removed and the original panel used in its original configuration without any residual holes in the picket(s)).
Figure 8C:
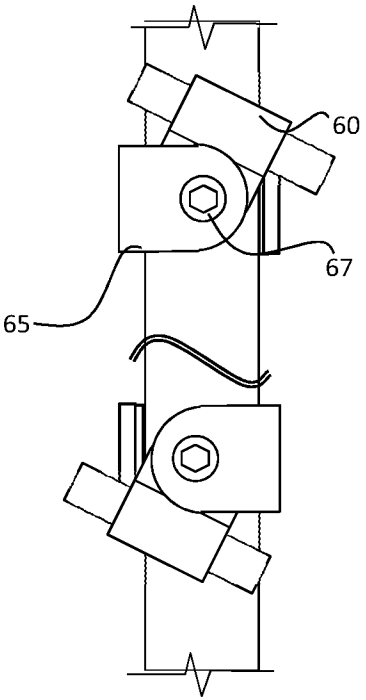
Figure 8B:
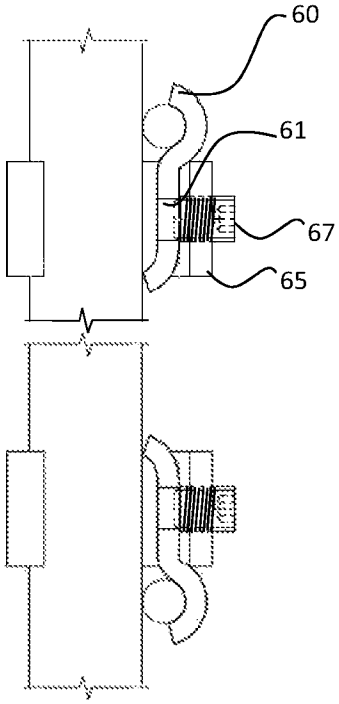
Figure 8A:
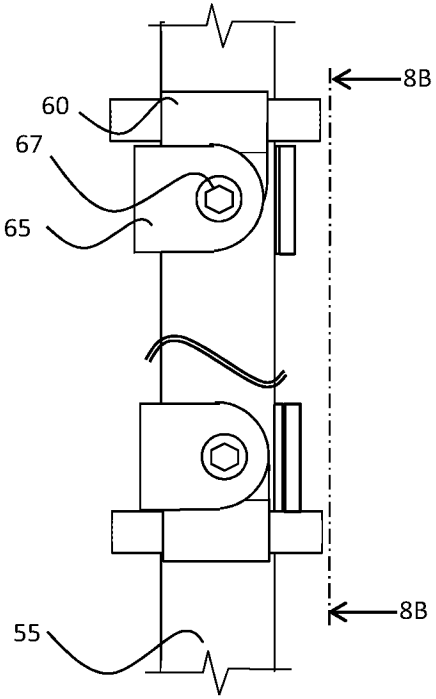
Figure 9:
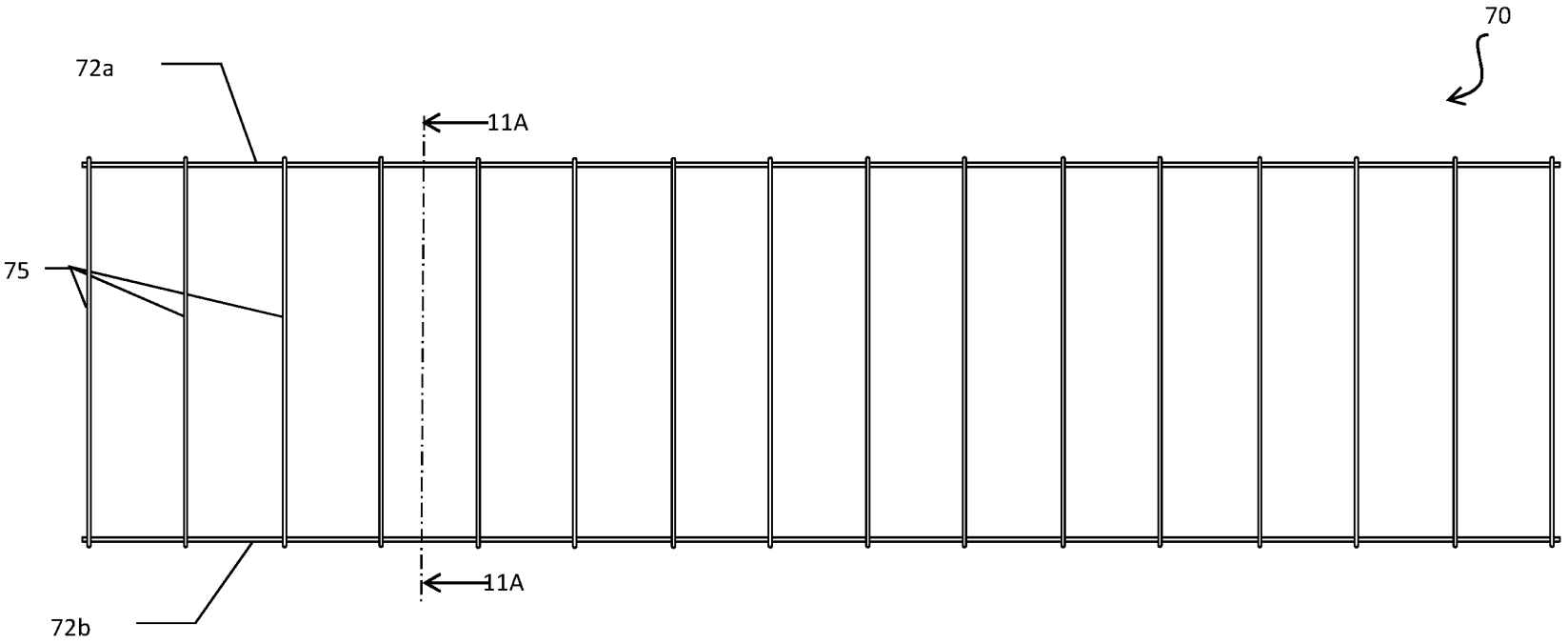
FIG. 9 is similar to FIG. 1, but illustrates still another of the many alternative embodiments of the invention. It is an elevation view of a supplemental fence apparatus/panel of the invention that permits lateral adjustment of the vertical picket spacing.

Preferably (for reasons of economy, aesthetics, ease of assembly, ease of maintenance, and/or otherwise), embodiments of the invention include relatively simple attachment structures by which the supplemental panel and/or portions thereof are attached to the main/existing fence panel structures. These attachments are shown herein in embodiments such as clip elements sized and configured to act between and affix the supplemental panel and the existing fence/barrier to each other. Such embodiments can provide substantial flexibility as to positioning and mounting the supplemental apparatus on an existing fence panel or other barrier (and subsequently removing the supplemental panel if the need for goes away). Persons of ordinary skill in the art will understand, however, that attachment and/or other affixation between the existing fence structure and the panel 10 can be accomplished in any suitable manner, including permanent (via welding or gluing) or temporary (via clips 60 and screws 62 or similar means). FIGS. 6, 7, and 8 show just some of the many ways in which the supplemental panel can be joined to an existing fence structure in a temporary manner, so that the supplemental panel(s) can subsequently be removed and the original/main/existing panels returned to their original configurations.

Figure 5:
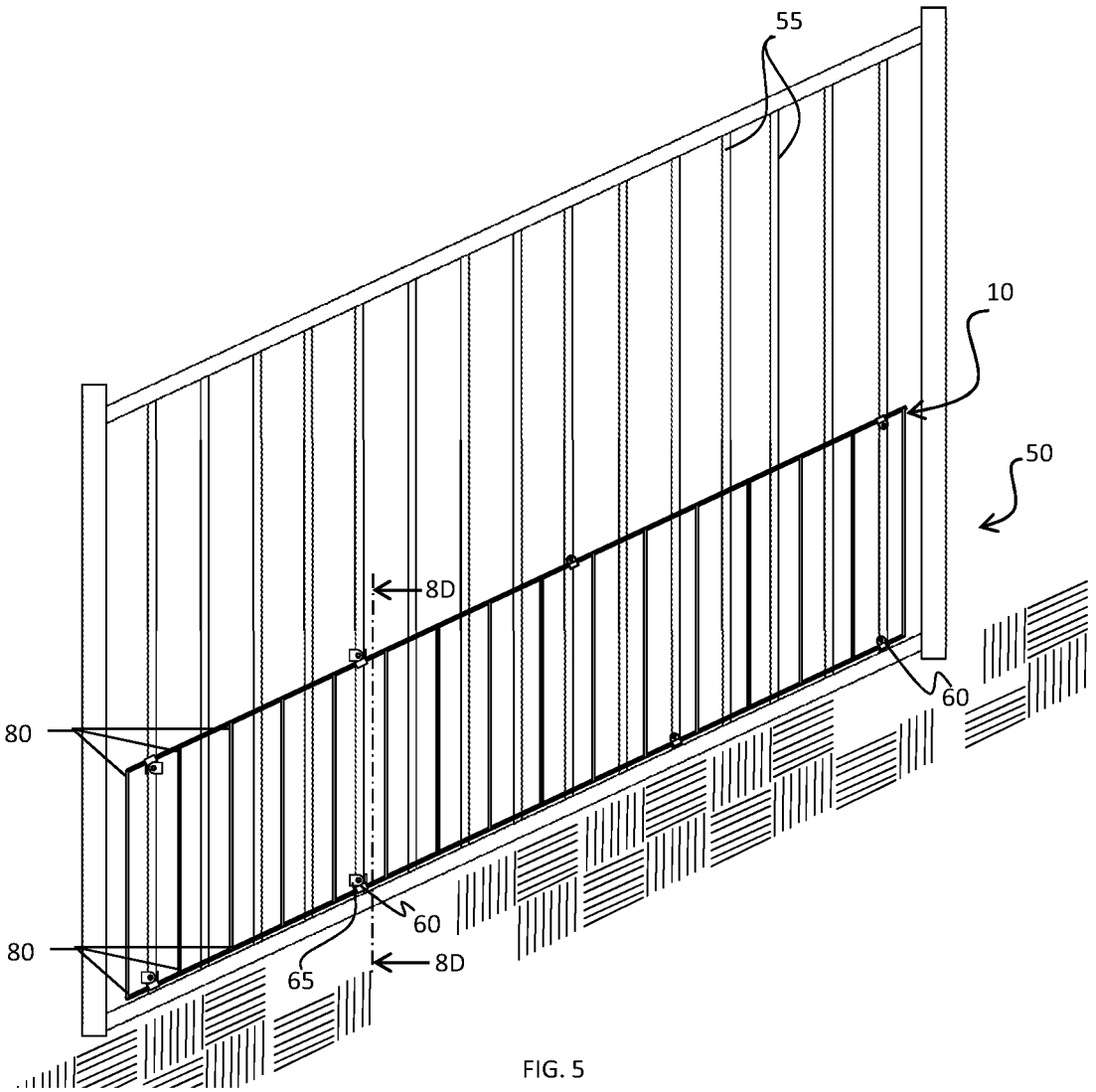
FIG. 5 is a front elevation view similar to FIG. 2, but shows a sloped/racked installation (rather than the generally "true" horizontal rail structure/positions of FIG. 2) that can be accomplished by bending the picket elements into a configuration such as shown in FIG. 4B.

Preferably, and as shown (for example) in FIG. 5, embodiments of the invention include means for racking of the vertical elements into a generally parallel relationship with the existing fence/barrier vertical pickets and/or related "horizontal" or sloped elements. The assembly preferably can be racked easily into a desired "slanted" configuration by the provision of depressions 80 or similar elements in the vertical pickets 14 (preferably near the points at which the pickets 14 are welded or otherwise affixed to the rail 12). Persons of ordinary skill in the art will understand that cross-hatching is used under the main/existing fence panel 50 in FIG. 5, to generally indicate the grade or slope of the ground underlying the fence panel(s) and/or assemblies. In any given embodiment, the grade may be relatively linear (as shown in FIG. 5), or may be more random or non-linear even though trending generally along the grade shown by the cross-hatching in FIG. 5.

Some of the many alternative ways to provide the desired racking function in the supplemental panels/structures of the invention (so that the supplemental panels can be functionally and/or aesthetically aligned with the existing panel(s) are illustrated in FIGS. 9-17.

Also preferably, and/or in certain embodiments, the supplemental elements such as pickets 14 are laterally offset from the plane of the existing fence/barrier (such as by the spacing inherent in the placement of horizontal members 12 (FIGS. 4A and 4B), thus providing even more flexibility in the relative positioning between the existing fence panel and the supplemental structure. By way of example, the supplemental panel element can thus be "offset" and readily positioned to extend below the existing fence/barrier, even if (as shown in FIG. 6B) the lower horizontal element 52 is wider than the vertical existing elements 57. For aesthetic or other reasons, that same "offset" can be beneficially used in other embodiments such as illustrated in FIG. 6C, to align the vertical elements 14 with one side of the main/existing vertical elements 57. Persons of ordinary skill in the art will understand that this can be accomplished, for example, by simply reversing the orientation of the supplemental panel—in other words, the same supplemental panel can be affixed to the main/existing panel in at least either of two orientations, which alternatives are illustrated in FIGS. 6A and 6C. In FIG. 6A, the vertical elements 14 are to the left of the horizontal members 12/12*b*, while in FIG. 6C, the supplemental assembly is reversed with respect to the existing fence panel so that the vertical elements 14 are to the right of the horizontal members 12/12*b* (and the vertical elements 14 are spaced between the main/existing vertical elements 55).

As with the main/existing fence panels/structures, the precise number and size and position of the generally horizontal rail and generally vertical picket elements in the supplemental panels can be selected to accommodate a wide variety of applications. By fabricating the elements from generally small-diameter bendable wire, the assembly can be provided in a relatively lightweight and low-profile (aesthetically pleasing) form, and can be fabricated and distributed in a relatively cost-effective way and installed in a labor-friendly (less demanding) manner.

Persons of ordinary skill in the art will understand that the supplemental panel of the invention can be affixed to the main/existing panel in any suitable manner, including relatively "temporary" or removable embodiments, or in a relatively "permanent" affixation (such as by welding, gluing, or the like). Racking/alignment functionality can be provided in the supplemental panel in virtually any of those embodiments. Examples of some of the many temporary/removable mounting concepts usable to practice the invention are shown in FIGS. 6, 7, and 8. The drawings in FIGS. 6 and 7 show a plurality of clamp elements 60 that can be affixed to main/existing vertical elements such as element 55 or 57 and fixed into a desired position by any suitable means, such as by a screw 62. Preferably the attachment is sufficiently tight (via friction fit or otherwise) to hold the supplemental panel in a desired location and orientation with respect to the main/existing panel. FIG. 7C illustrates one of the many ways in which the connection between the two panels can accommodate or provide the desired racking discussed herein. Persons of ordinary skill in the art will understand that the use of a clamp is merely exemplary, and the precise size and configuration and orientation of any such clamp or other attachment mechanism can be selected based on the particular embodiment of the invention, to provide a sufficiently strong affixation and positioning of the panels with respect to each other.

As discussed elsewhere herein, in certain embodiments, the nature of the connection mechanism helps ensure that the supplemental panel can be readily removed at a later time (such as after the user's pet grows larger and no longer can fit between the gaps in the main/existing fence panel), and that the main/existing panel can thereafter be used in its original state (without the supplemental panel). In that regard, embodiments such as shown in the drawings of FIG. 8 can be provided and used to eliminate even a screw hole from being formed in the main/existing panel (such as may be required for certain embodiments using screws such as screws 62 in FIGS. 6 and 7). In FIG. 8, a clamp element 60 (or any other suitable clamp/gripping element) preferably similarly engages with the supplemental panel such as by cupping a horizontal element 12 at a selected location) but is then tightened into a friction/gripping relationship onto a selected location of the main/existing panel (such as onto a vertical element) by an encircling C-clamp or other structure 65. By tightening or loosening a set screw 67, the assembly (C-clamp 65, clamp element 60, and horizontal element 12) can be positioned/released into or from a desired relationship with the main/existing fence panel.

Figure 4B:
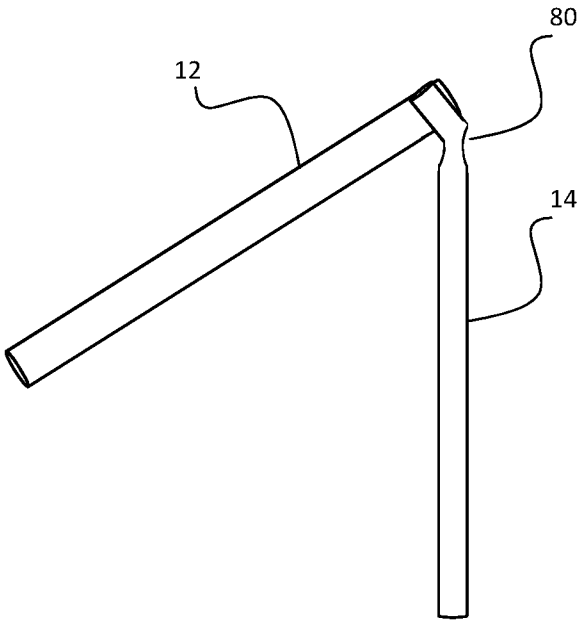
FIG. 4B is similar to FIG. 4A, but shows the vertical picket in a generally bent configuration relative to the rail element (rather than generally perpendicular to the rail as in FIG. 4A).
Figure 4A:
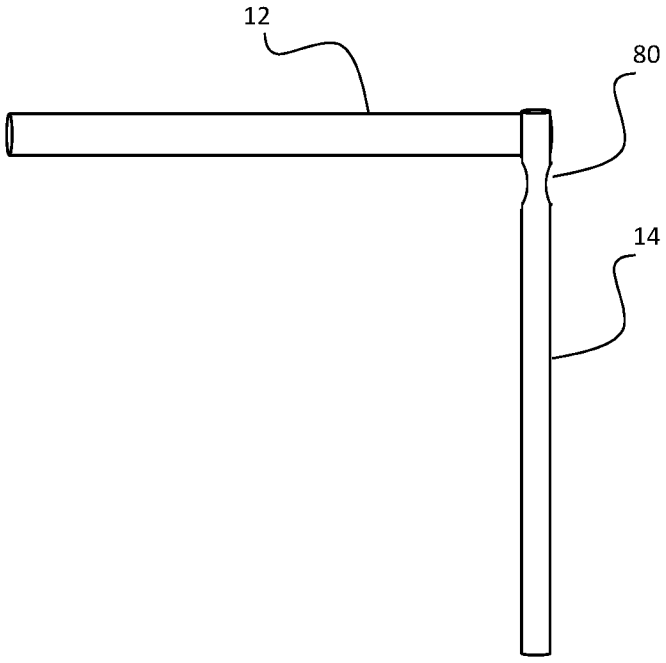
FIG. 4A is a close-up view of one of the many ways in which a racking feature can be provided in the present inventions, such as by forming narrowed/bendable portions in the vertical picket elements of the invention, near the point of attachment between the vertical picket element and the horizontal rail element.

As shown in FIG. 4B, the desired racking function of the invention can be provided by thinning or stretching or otherwise forming a depression 80 on the vertical elements 14 near the connections to one or more horizontal members 12. Persons of ordinary skill in the art will understand that these "thinned" areas 80 preferably are configured to permit relatively easy bending of the elements 14 at those locations, so that the horizontal member(s) 12 can be generally aligned parallel with the grade and/or the main panel's horizontal members and vertical member(s) 14, even when those main panel members are not at right angles. Attachment of such "racked" embodiments to the main/existing panels are illustrated in, for example, FIGS. 5, 7C, and 8C. Persons of ordinary skill in the art will understand that, for any such affixation of the panels to each other, the precise number and location of any welds, glue, clamps, etc. can be selected based on the needs and anticipated uses of the particular embodiment, to ensure that the installation is sufficiently safe and strong for the specific situation involved.

Other examples of the many alternative ways to provide the desired racking are illustrated in FIGS. 9-17. As noted elsewhere, this racking (in whatever manner it is provided) can accommodate vertical alignment of those picket elements even if the terrain/existing fence traverses a grade (rather than the terrain being "truly" flat horizontally). Persons of ordinary skill in the art also will understand that this "racking" provides at least general alignment into a parallel relationship of any "horizontal" elements in the supplemental panel(s) with corresponding "horizontal" elements in the main/existing fence panel.

Figure 10:
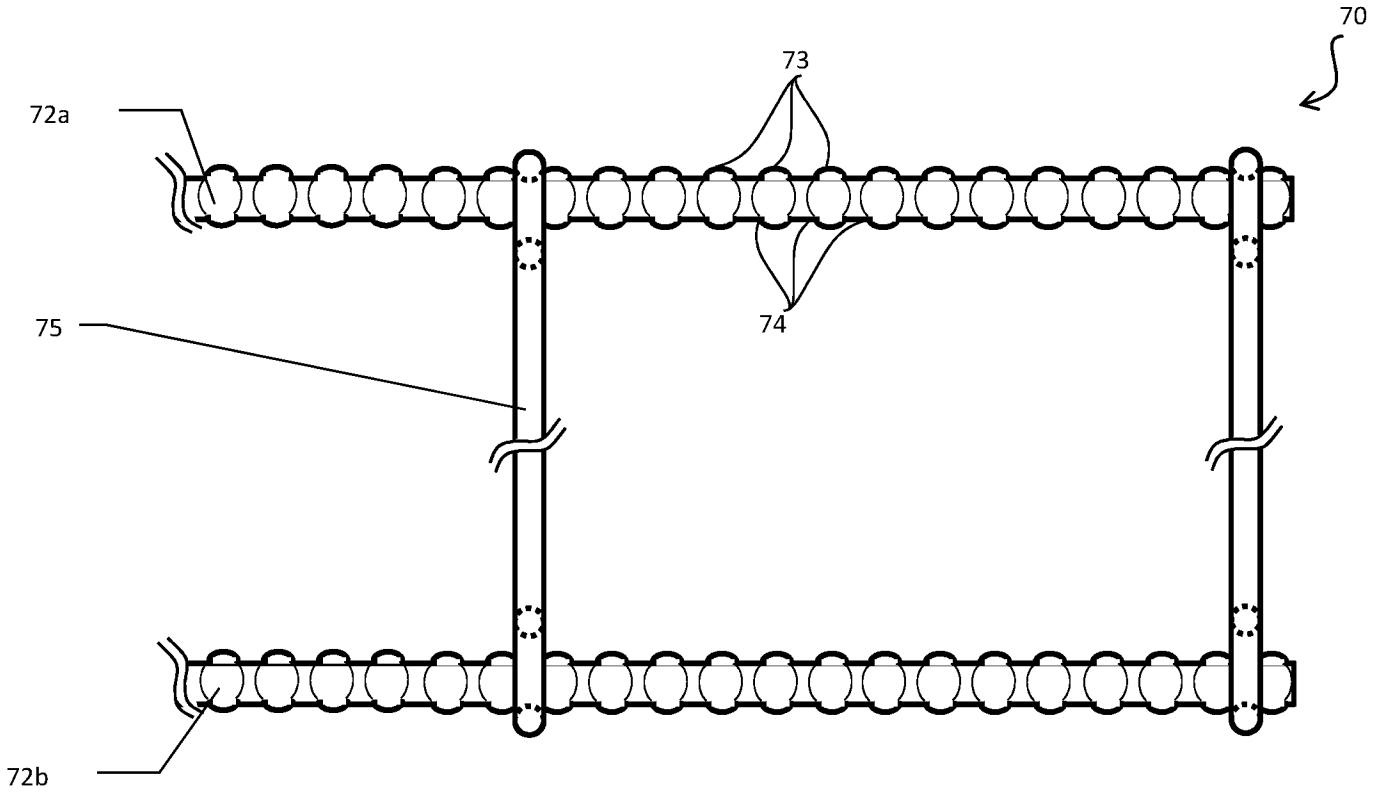
FIG. 10 is an enlarged and foreshortened view of a portion of FIG. 9, showing some of the many alternative ways to provide lateral adjustability of the vertical pickets, including details of horizontal rails with spaced detents and depressions that can be used to hold the pickets at a selected position laterally in the embodiment of FIG. 9.
Figure 11B:
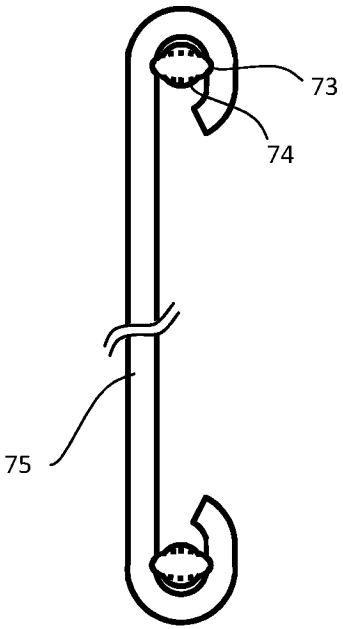
FIG. 11B is similar to FIG. 11A, but shows the horizontal rail members rotated 90°, to lock them into an interfering relationship with the vertical pickets and thereby restrict the horizontal movement of the pickets along the length of the horizontal rails. Preferably, and as shown in the drawings, the size and/or shape of the vertical pickets' extremities are loops that preferably allow for racking or biasing the supplemental panel to match or approximate the grade underlying the panel(s).
Figure 11A:
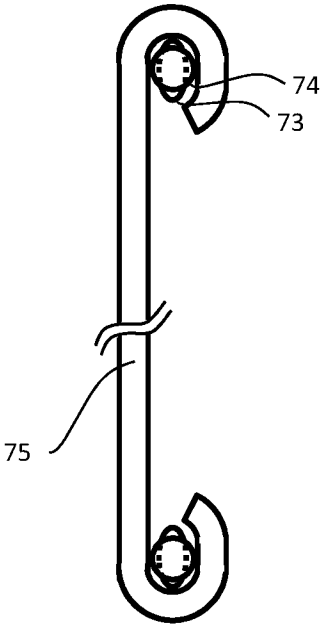
FIG. 11A is an elevation view similar to that taken along line 11A-11A of FIG. 9, but showing the horizontal rails of the supplemental panel rotated so that the plurality of detent elements are positioned relatively vertically with respect to the center of their respective horizontal rail members. This orientation permits the vertical pickets to be moved horizontally along the length of the horizontal rails (to the left/right as shown in FIG. 9) for lateral spacing adjustment.

For example, the loops formed or otherwise provided on each end of vertical element 75 in FIGS. 10 and 11 (and on vertical element 95 in FIGS. 12 and 13) preferably are selectively positioned laterally (to the left or right as viewed in FIG. 10, for example) at a desired location along the length of the horizontal members 72*a* and 72*b* in FIG. 10 (and horizontal members 92*a* and 92*b* in FIG. 12), and are sized and configured sufficiently "loosely" in relation to the surfaces contacting those horizontal members so that the respective horizontal and vertical elements in the supplemental assembly 70 (in FIG. 10, or 90 in FIG. 12) can be "racked" into the same slope as the main fence and then "fixed" in that sloped/angled position to the main/existing fence panel.

Figure 12:
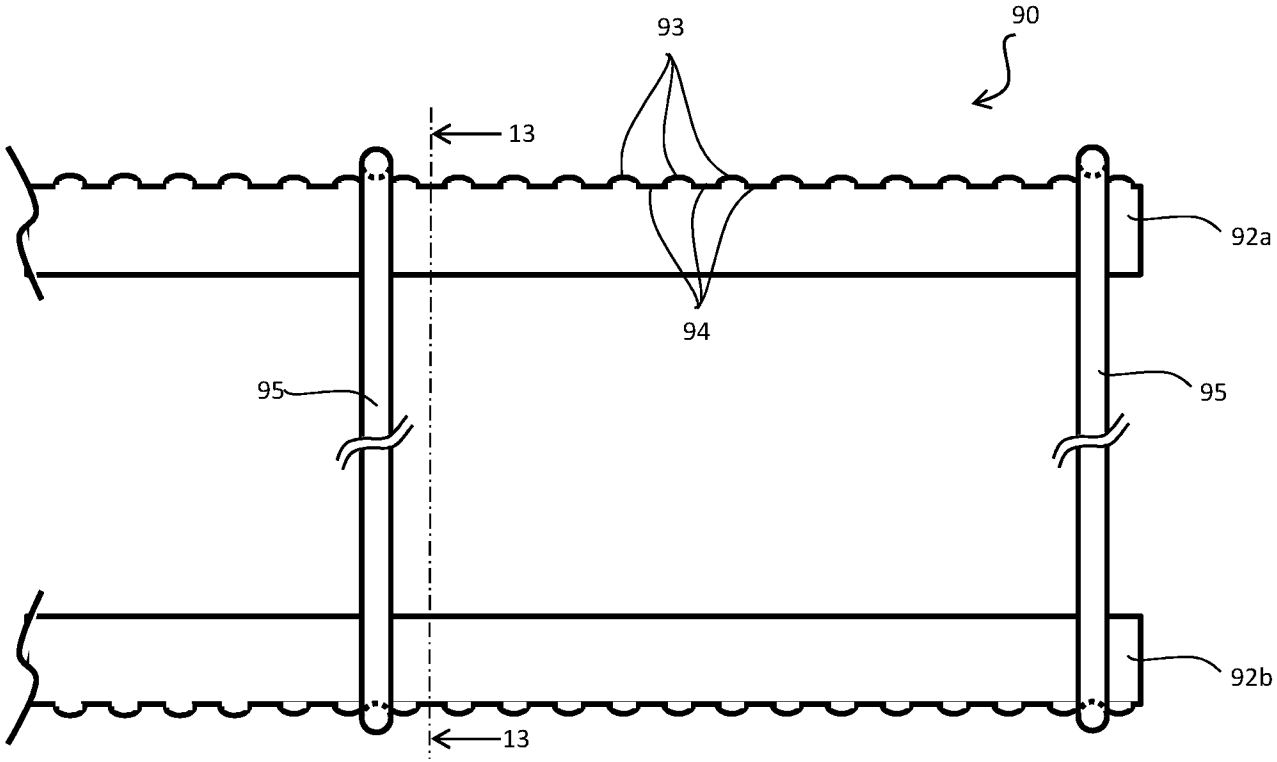
FIG. 12 is similar to FIG. 10, but illustrates yet another of the many embodiments of the invention, Among other things, it shows an alternative embodiment of the adjustable panel using notched top and bottom rails to allow selective lateral positioning of the vertical pickets, as well as racking to match the grade underlying the fence panel(s).

Although the lateral spacing between the supplemental vertical pickets can be random and/or varied (as can the spacing of the main/existing panel), preferably (for aesthetic and/or functional reasons) the vertical pickets are spaced and positioned at regular intervals along their respective horizontal rail elements (such as elements 70 and 90, FIGS. 10 and 12, respectively, or rails 12*a* and 12*b* in FIG. 1). Because such main/existing fence panels can be custom made to fit a given space, the lateral spacing of such vertical members can vary from site to site. Thus, a single supplemental rail assembly may have lateral spacing that works for (or matches the lateral/horizontal spacing of) many or even most such existing fence panels, but certainly will not match all such custom fences. Accordingly, in certain embodiments of the present invention, the supplemental panel assembly (such as panels 70 and 90 and 120, in FIGS. 10 and 12 and 15, respectively) can be provided in a form that permits the vertical pickets to be adjusted laterally into a corresponding custom spacing so that they will be positioned generally (or more commonly "halfway") between the existing fence's vertical pickets/posts (such as vertical posts 57 in FIG. 3). As indicated above, in many or even most embodiments, regular even spacing of the supplemental vertical pickets 14 (especially spacing that matches that of the main/existing fence panel) will help the supplemental vertical pickets 14 blend visually/aesthetically into the overall assembly with the existing fence panel on which they are mounted.

Figure 13:
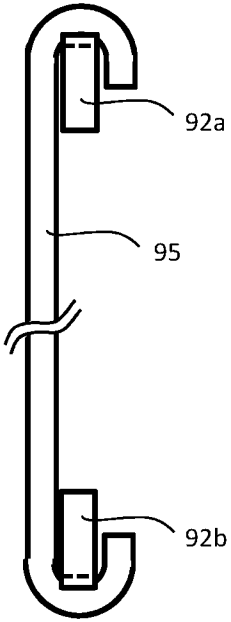
FIG. 13 is a section view taken along line 13-13 of FIG. 12.

FIGS. 9-13 and 15-17 show examples of the many alternative ways to provide such adjustable positioning laterally of the vertical elements (such as elements 75 and 95 and 130/132/134 respectively in FIGS. 9-11B and 12-13 and 15-17). When the horizontal supplemental rails are positioned as in FIG. 11A, the preferred plurality of vertical elements 75 can be "slid" along the length of those horizontal rails into respective desired lateral positions, and then the horizontal rails can be "rotated" into the position shown in FIG. 11B to "lock" the vertical element(s) 75 into those lateral positions. Persons of ordinary skill in the art will understand that the entire assembly 70 can then be racked as needed and fixed to the main/existing fence panel. The example of FIGS. 12 and 13 is similar, but does not require the rotation of the horizontal elements 92*a* and 92*b*.

Figure 14:
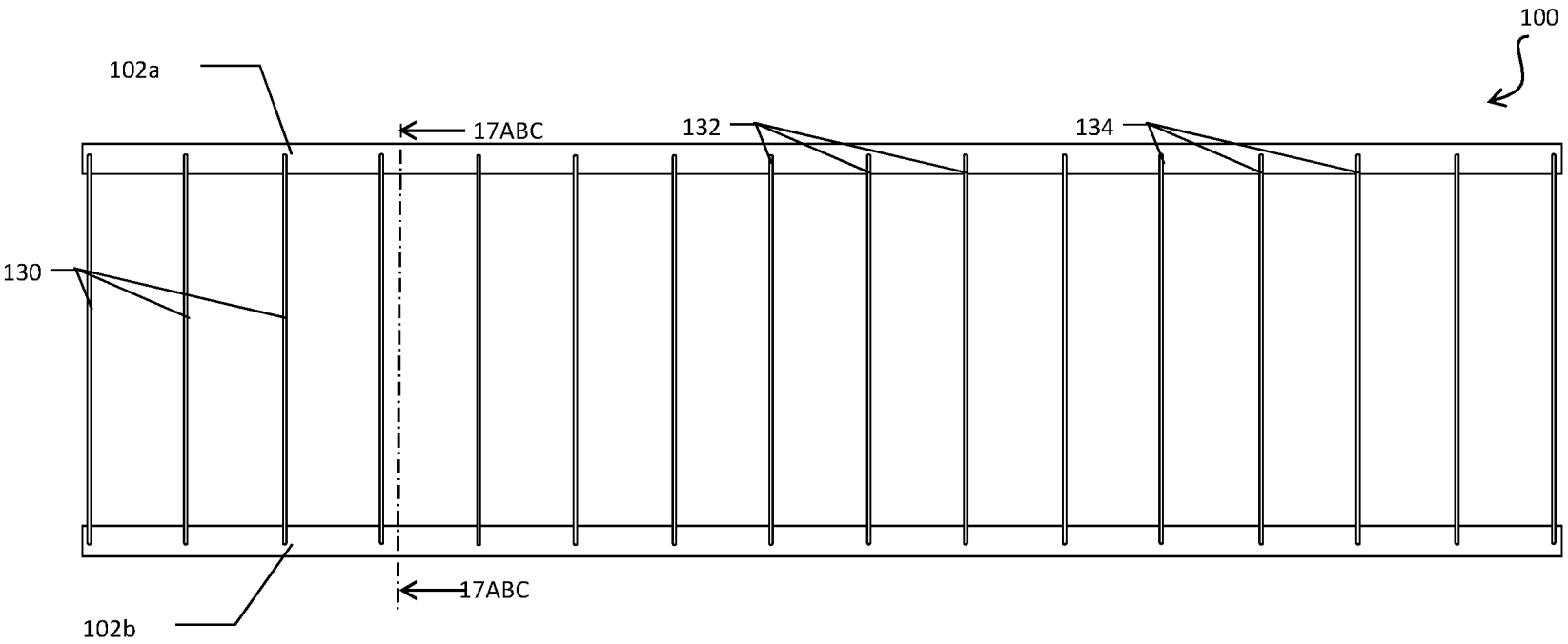
FIG. 14 is a front elevation view illustrating yet another of the many embodiments of the supplemental panel of the invention, with vertical pickets that penetrate the rails to allow racking since the pickets are not welded in place.
Figure 15:
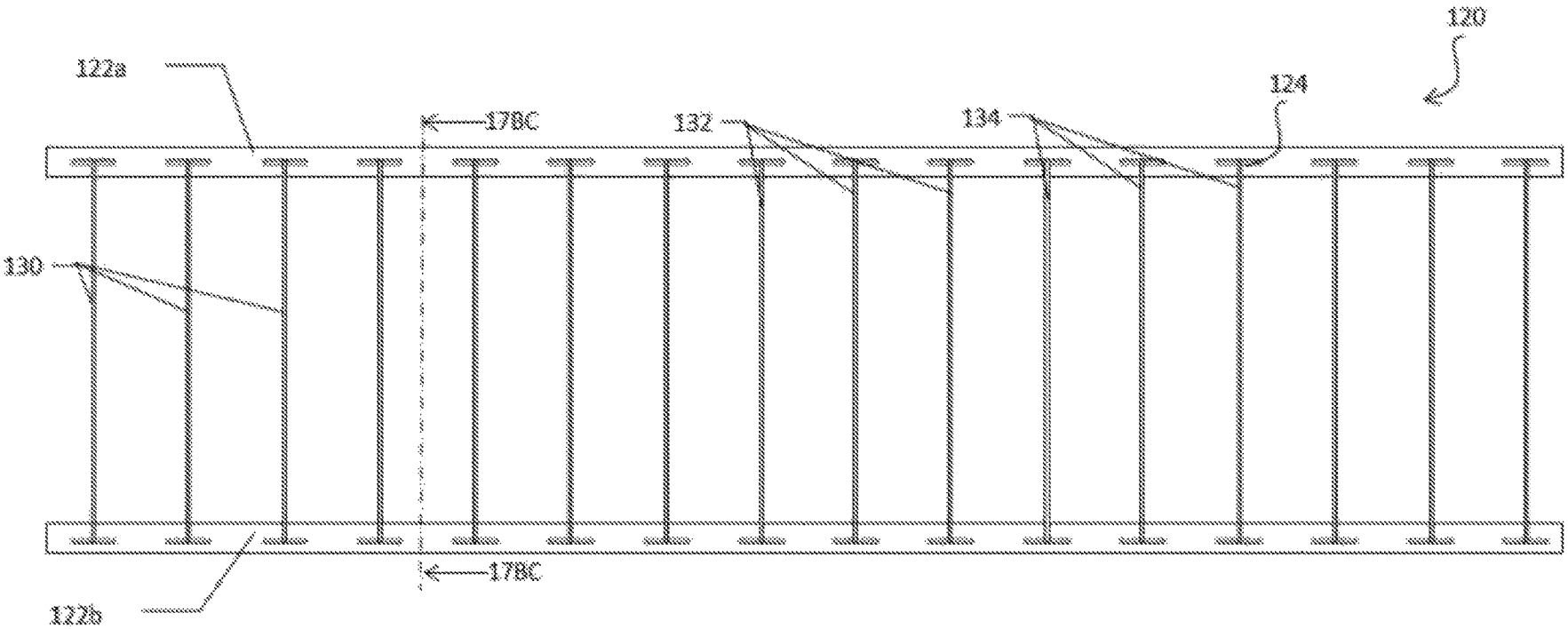
FIG. 15 is similar to FIG. 14, but includes in the horizontal elements selectable insertion points to permit lateral adjustment of the positions of the vertical members along the length of the horizontal members.
Figure 16:
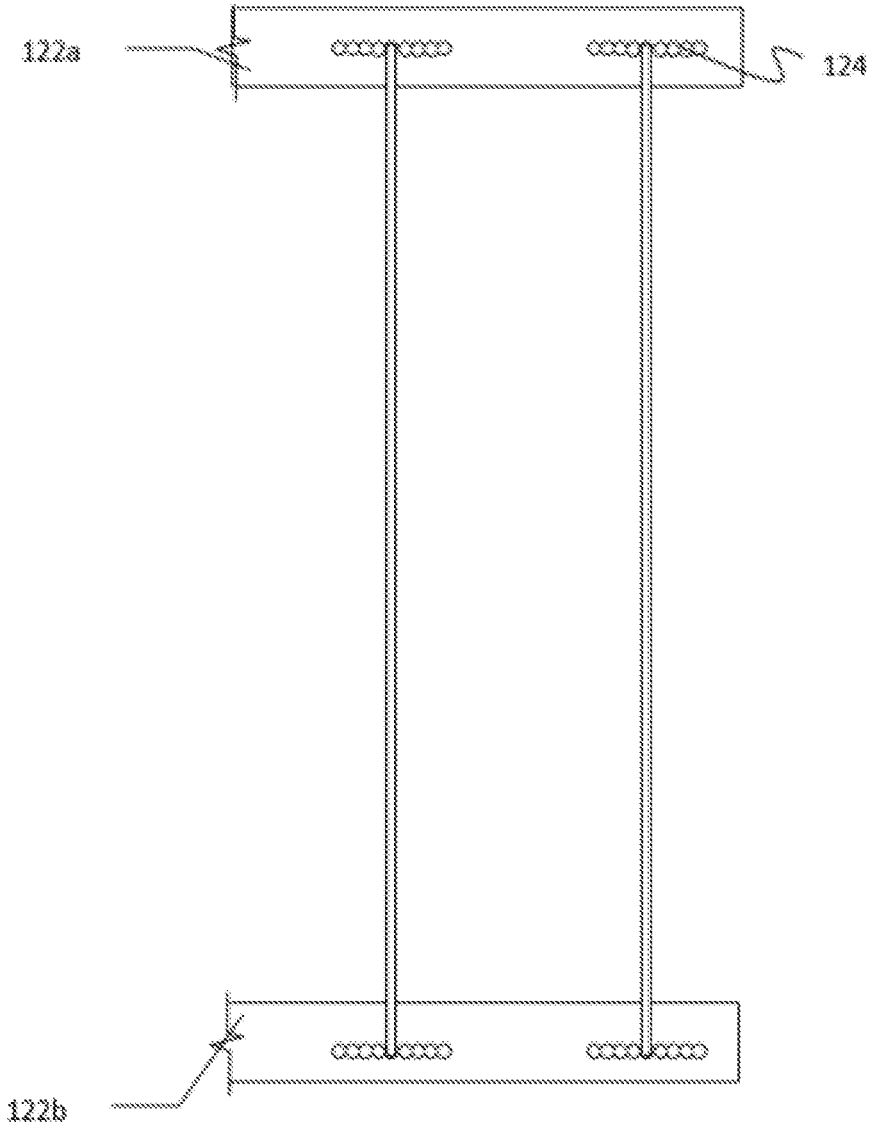
FIG. 16 is an enlarged and foreshortened section view of the embodiment of FIG. 15.
Figure 17C:
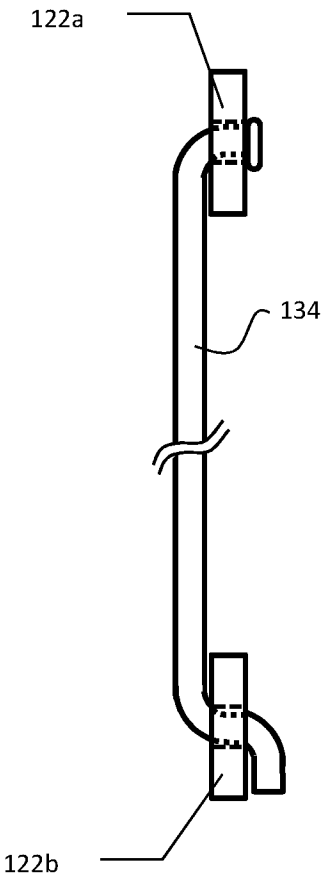
FIGS. 17A, 17B, and 17C are sectional side views (such as taken along lines 17ABC-17ABC of FIGS. 14 and/or 17BC-17BC of FIG. 15) illustrating some of the many embodiments of vertical picket members that may be used beneficially in embodiments such as those shown in FIGS. 14, 15, and 16.
Figure 17B:
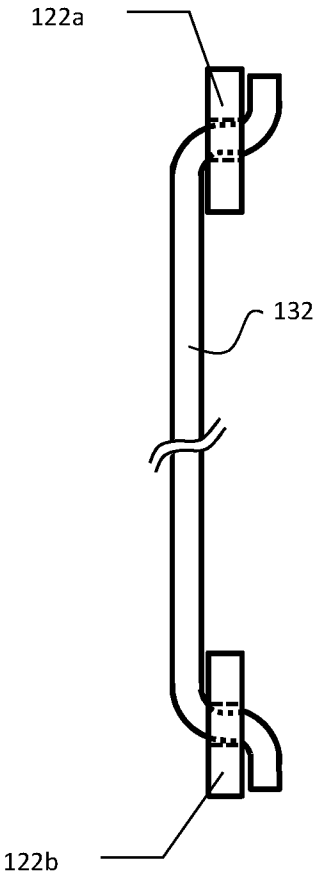
Figure 17A:
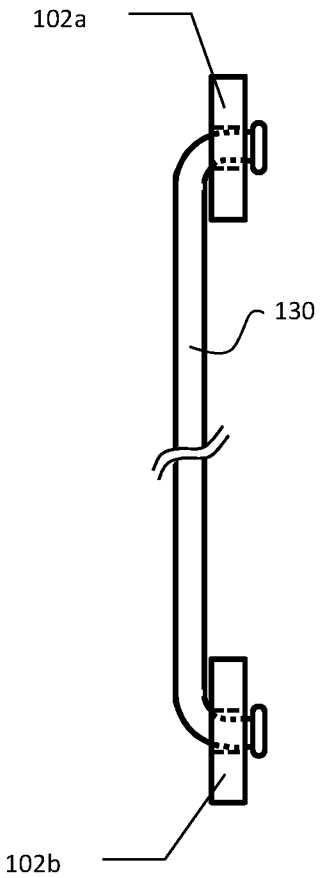

FIGS. 14-17 show a few more of the many alternative embodiments in which the inventions can be practiced. FIG. 14 does not provide for lateral adjustment of the position of the supplemental vertical pickets, but the embodiment of FIGS. 15 and 16 does provide lateral adjustment. FIGS. 17A-C show some of the many examples of how vertical elements (130/132/134) may be operatively engaged with horizontal supplemental elements (such as those shown in FIGS. 14-16). Persons of ordinary skill in the art will understand that, among many other ways, the vertical elements can be retained "permanently" engaged with their respective horizontal elements by pressing or forming or attaching a flat "head" onto the end of the vertical element (see element 130 in FIG. 17A, or the upper end of element 134 in FIG. 17C). Temporary/laterally adjustable engagement can be provided, for example, by bending the ends of elements 132 or the lower end of element 134 as shown in FIGS. 17B and 17C, respectively, so that once mounted into assembly with an existing fence panel (with the horizontal elements 122*a* or 122*b* spaced vertically apart from each other sufficiently), the vertical element (132/134 is "locked" into a selected lateral position along its respective horizontal member 122*a* or 122*b*. Persons of ordinary skill in the art will further understand that assemblies such as shown in FIGS. 17A-C permit rotation of the vertical elements 130/132/134 with respect to their respective horizontal elements prior to final "fixed" assembly of the supplemental panel to the main/existing fence panel, so as to permit any desired racking to match the existing slope of the main/existing panel and/or the underlying ground/grade. Lateral adjustment of the vertical members can be provided in any suitable manner, such as by providing a series of adjacent and/or intersecting holes 124 at desired spacing along the length of horizontal supplemental elements 122*a* and 122*b*, FIG. 16.

In certain embodiments, one or more additional "horizontal" rail members (such as element 12*b* in FIG. 1, or rail 122*b* in FIG. 16) can be provided on the supplemental panel. Among other things, these can strengthen the supplemental panel and/or the overall assembly, and/or can be used to provide additional safety for pets. For example, such additional elements can act as a further barrier's to the pets' undesired escape from captivity, and also can keep pets from injuring themselves on the exposed lower "ends" of the vertical pickets 14.

The foregoing apparatus can be fabricated and assembled and used in a wide variety of embodiments and methods. For example, a fixed supplemental panel can be fabricated from strong, light-weight material and affixed to an existing fence panel, at a useful lateral/vertical/horizontal position thereon. For keeping puppies or other small animals inside a fence, this typically would be at or near the "bottom" of the existing fence. The supplemental panel can be provided with the ability to be racked, and for appropriate installations, the supplemental panel can be "racked" or adjusted to approximate the slope of the corresponding existing vertical/horizontal elements on the fence. In certain installations and with certain embodiments of the invention, the lateral spacing of the supplemental panel's vertical elements can be selected prior to affixing the supplemental panel to the existing panel. Once the puppy has grown sufficiently large so that it can't fit between the existing fence panel elements (or the other reason for adding the supplemental panel is gone), for certain embodiments of the invention the supplemental panel can be removed, leaving the original/main/existing panel in its "virgin" condition (or approximately so). Other methods of assembly and use of the apparatus of the invention will be apparent to persons of ordinary skill in the art, in addition to those described herein.

The present invention is described herein with reference to the accompanying Figures, which serve as illustrations of some of the many embodiments in which the invention may be practiced. Subject to the context and other factors (including for example the understanding of persons of ordinary skill in the arts relevant to the inventions), generally in those Figures and references similar reference numerals refer to similar or identical elements throughout this description.

Those Figures and references, and the other terminology used in these descriptions, are not intended to be interpreted in any limited or restrictive manner, simply because they are being utilized in conjunction with a detailed description of certain embodiments of the invention. Furthermore, various embodiments of the invention (whether or not specifically described herein) may include one or more of the novel features disclosed herein, no single one of which (a) is necessarily solely responsible for any particular desirable attribute(s) of the inventions or (b) is essential to practicing the inventions described.

For the purpose of summarizing the invention certain objects and advantages have been described herein. It is to be understood that not necessarily all such objects or advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other objects or advantages as may be taught or suggested herein.

These and other embodiments will become readily apparent to those skilled in the art from the detailed description herein of the preferred embodiments having reference to the attached figures, the invention not being limited to any particular preferred embodiment(s) disclosed. In other words, the apparatus and methods of the invention have been described with some particularity, but the specific designs, constructions, and steps disclosed are not to be taken as delimiting of the invention. A wide range of modifications and alternative structures and steps for practicing the invention will make themselves apparent to those of ordinary skill in the art, all of which will not depart from the essence of the invention, and all such changes and modifications are intended to be encompassed within the appended claims.

Although the methods or processes of the present invention are illustrated herein with steps occurring in a certain order, the specific order of the steps, or any continuation or interruption between steps, is not required.

What is claimed is:

1. A supplemental fence apparatus including:

at least one existing fence, the existing fence panel comprising at least one generally horizontal element and a plurality of generally vertical posts operative affixed thereto;

at least one generally lateral rail having a plurality of detents spaced laterally along its length;

a plurality of vertical pickets attached to said at least one lateral rail, each one of the plurality of pickets being positioned on an exterior of said rail and within one of said plurality of detents at a selected lateral position along the length of said lateral rail, said pickets positioned in an orientation parallel with each other and at an angle to said lateral rail;

means for selectively adjusting the lateral positioning of said plurality of vertical pickets of said supplemental fence into a spacing configuration which generally corresponds with the plurality of vertical posts of the existing fence, and means for affixing said supplemental fence apparatus to the existing fence.

2. The supplemental fence apparatus of claim 1, said angle between said vertical pickets and said lateral rail being selectably adjustable to facilitate (a) orienting said lateral rail to an angle that is generally parallel to an at least partially non-level surface underlying the existing fence and (b) racking said pickets into a vertical position.

3. The supplemental fence apparatus of claim 1, in which the adjustable lateral spacing is provided by a plurality of engagement elements laterally spaced along the length of said at least one generally lateral rail.

4. A method of preventing small animals from passing through a fence, including:

providing a supplemental fence apparatus of claim 1;

affixing said supplemental fence apparatus to an existing fence;

racking said supplemental fence apparatus into generally parallel alignment with components of the existing fence; and positioning said supplemental fence apparatus laterally so that a plurality of vertical pickets on said supplemental fence apparatus are positioned between corresponding vertical posts of the existing fence.

5. The supplemental fence apparatus of claim 1, wherein said spacing configuration includes said plurality of vertical pickets being positioned generally between said plurality of vertical posts of the existing fence.

6. The supplemental fence apparatus of claim 5, wherein said plurality of vertical pickets are positioned halfway between said plurality of vertical posts of the existing fence.

7. Apparatus for confining small animals into a limited area, including:

at least one existing fence panel having at least one generally horizontal element and a plurality of generally vertical pickets operatively affixed thereto;

at least one supplemental panel having at least one generally horizontal element and a plurality of generally vertical pickets operatively affixed thereto;

means for selectively adjusting the angle(s) between said supplemental panel's at least one generally horizontal element and said plurality of generally vertical pickets operatively affixed thereto;

said supplemental panel's at least one generally horizontal element having a plurality of depressions along its length for engaging said plurality of generally vertical pickets on an exterior of said rail and within said depressions at selected lateral positions along the length of said at least one generally horizontal element, said plurality of depressions providing selective adjustability of lateral spacing between said supplemental panel's plurality of vertical pickets into a configuration generally corresponding with a spacing configuration of said existing panel's plurality of vertical meters; and means for affixing said supplemental panel to said existing panel in a desired relationship therebetween.

8. Apparatus for confining small animals into a limited area, including:

at least one existing fence panel having at least one generally horizontal element and a plurality of generally vertical pickets operatively affixed thereto;

at least one supplemental panel having at least one generally horizontal element and a plurality of generally vertical pickets operatively affixed thereto;

means for selectively adjusting the angle(s) between said supplemental panel's at least one generally horizontal element and said plurality of generally vertical pickets operatively affixed thereto, said means for adjusting the angle(s) including thinned portions of the supplemental panel's plurality of generally vertical pickets, said thinned portions making the pickets selectively bendable at the location of those thinned portions;

means for selectively adjusting the lateral spacing between said supplemental panel's plurality of vertical pickets wherein the lateral spacing between said supplemental panel's plurality of vertical pickets corresponds with the lateral spacing provided between said existing panel's vertical pickets; and means for affixing said supplemental panel to said existing panel through one or more interference fits engaging said supplemental panel and existing panel with each other.

9. Apparatus for confining small animals into a limited area, including:

at least one existing fence panel having at least one generally horizontal element and a plurality of generally vertical pickets operatively affixed thereto;

at least one supplemental panel having at least one generally horizontal element and a plurality of generally vertical pickets operatively affixed thereto;

means for selectively adjusting the angle(s) between said supplemental panel's at least one generally horizontal element and said plurality of generally vertical pickets operatively affixed thereto;

means for selectively adjusting the lateral spacing between said supplemental panel's plurality of vertical elements such that the lateral spacing between said supplemental panel's plurality of vertical pickets is equivalent to the lateral spacing provided between said existing fence panel's vertical pickets; and means for affixing said supplemental panel to said existing panel so that said plurality of vertical pickets on said supplemental panel are positioned between corresponding vertical pickets of the existing fence panel.

10. The fence apparatus of claim 9, in which said at least one interference engagement element comprises a clamp and said separate interference element comprises a C-clamp.

11. The fence apparatus of claim 10, in which said fastening means comprises a set screw positioned between the clamp and C-clamp, whereby tightening or loosening of the set screw correspondingly tightens or loosens the engagement of the supplemental panel and the existing panel with each other.

12. A fence structure, including:

an existing barrier installed in a ground surface including parallel upper and lower elements and a plurality of vertical elements therebetween, said vertical elements being laterally spaced from each other;

a supplemental fence including:

at least one substantially horizontal rail;

a plurality of substantially vertical pickets affixed to said at least one rail in an orientation substantially parallel with each other and rotated at an angle to said horizontal rail, said vertical pickets including a loop formed at at least one end of the picket for engaging with said at least one rail at selected lateral positions along the length of said rail; and a plurality of interference attachment components selectably positioned along said assembled vertical pickets and/or said at least one horizontal rail for interferingly attaching said supplemental fence to the existing barrier such that each of said plurality of vertical pickets occupy a space between two laterally spaced vertical elements of said existing barrier.

13. The fence structure of claim 12, wherein said plurality of attachment components includes at least one clip element formed separately from said at least one rail and said plurality of pickets, said clip element sized and configured to be screwed to said existing barrier and to provide an interference fit holding said supplemental fence in a desired position relative to said existing barrier.

14. A method of preventing small animals from passing through a fence, including:

providing a supplemental fence of claim 12;

attaching said supplemental fence to said existing barrier of claim 12;

racking said supplemental fence to bring said pickets of said supplemental fence into parallel alignment with vertical elements of said existing barrier; and positioning said supplemental fence laterally on said existing barrier so that said plurality of pickets on said supplemental fence are positioned between corresponding ones of the vertical elements of said existing barrier.

15. The fence structure of claim 12, including means for selectively adjusting lateral spacing between said supplemental fence's plurality of vertical pickets.

16. The fence structure of claim 15, in which said means for adjusting the lateral spacing of said vertical pickets includes a plurality of engagement elements laterally spaced along the length of the supplemental fence's said at least one substantially horizontal rail.

17. The fence apparatus of claim 12, in which said plurality of interference attachment components includes at least one C-clamp element configured to interferingly engage with (a) (1) one of said existing barrier's parallel upper or lower elements and/or (2) at least one of the existing barrier's plurality of vertical elements and (b) said supplemental fence, said C-clamp element including a set screw for adjusting the engagement of said C-clamp element to hold said supplemental fence and said existing barrier in a desired position with respect to each other.

* * * * *